US005743623A

United States Patent [19]

Kerr

[11] Patent Number: 5,743,623

[45] Date of Patent: Apr. 28, 1998

[54] SELF-LOCKING FLASHLIGHT HOLDER

[76] Inventor: Daniel G. Kerr, 2922 East 25th Avenue, Vancouver, British Columbia, Canada, V5R 1J2

[21] Appl. No.: 713,217

[22] Filed: Sep. 12, 1996

[51] Int. Cl.[6] ..... F21L 7/00

[52] U.S. Cl. ..... 362/190; 362/110; 362/208; 362/399

[58] Field of Search ..... 362/190, 191, 362/202, 205, 208, 399, 110

[56] References Cited

U.S. PATENT DOCUMENTS 3,418,461 12/1968 Sedlock ..... 362/191
5,167,446 12/1992 Haroutunian ..... 362/110
5,580,157 12/1996 Patricca et al. ..... 362/191
5,601,356 2/1997 McWilliams ..... 362/103

*Primary Examiner*—Stephen F. Husar

[57] ABSTRACT

A flashlight holder for use with flashlights for security or law enforcement personnel, which has a cantilevered arm connected to a spacer arm and a removably attachable collar for affixing the spacer arm to the housing of a flashlight. When the holder is affixed to the flashlight a passageway is formed between the cantilevered arm and the flashlight housing which permits the passage of a hand therethrough. The flashlight holder permits the simultaneous holding of the flashlight with one hand and holding of a gun with the other hand in a manner that locks the movement of both gun and flashlight.

16 Claims, 3 Drawing Sheets

FIG. 4
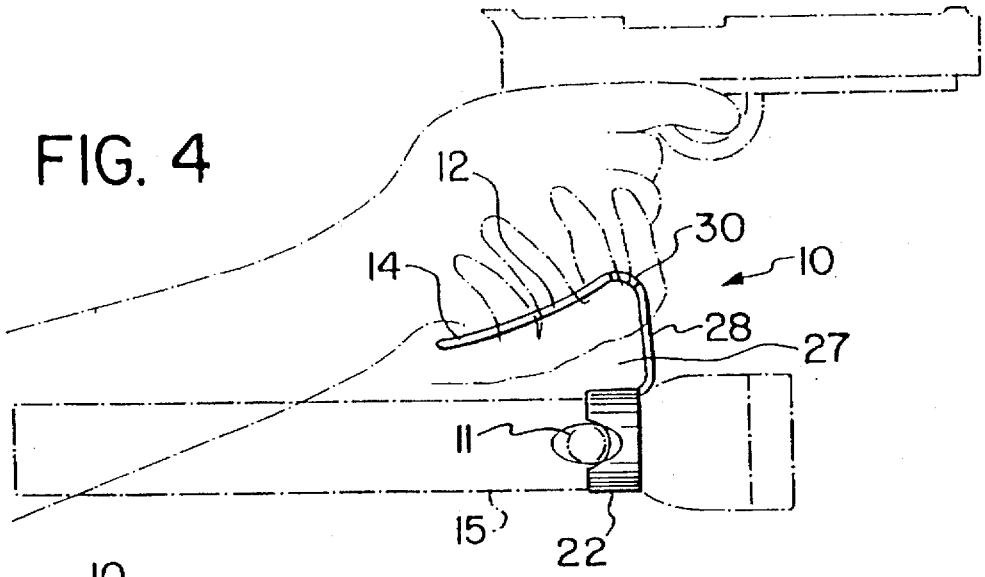
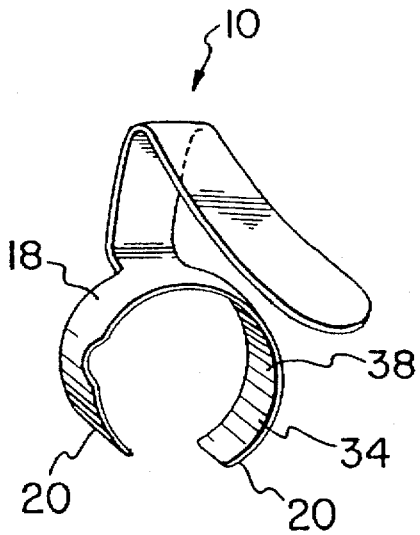
FIG. 5
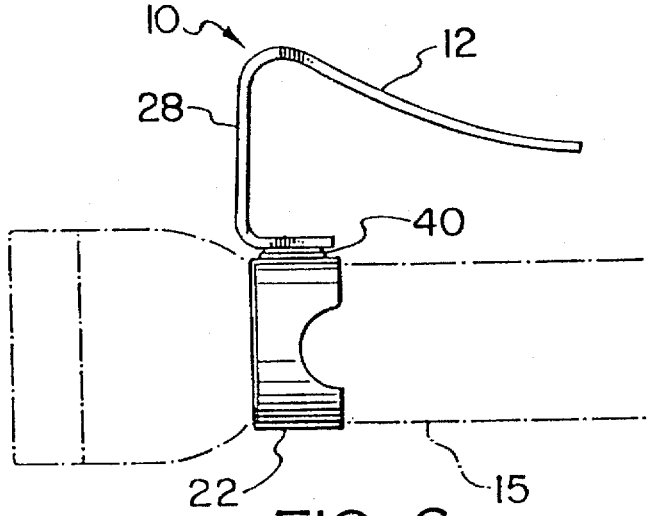
FIG. 6

SELF-LOCKING FLASHLIGHT HOLDER

FIELD

The present invention relates to a flashlight holder for use with flashlights for security or law enforcement personnel which permits the simultaneous holding of the flashlight with one hand and holding of a gun with the other hand in a manner that locks the movement of both gun and flashlight. The flashlight holder may be removably attached or may be integral with and form part of the flashlight casing.

BACKGROUND

The lack of handles on many flashlights makes them unsuitable for many situations, especially in the area of law enforcement and security operations, where officers regularly require the use of both a flashlight and a firearm. Commonly, using both a flashlight and a firearm requires a law enforcement officer to hold a flashlight in one hand while holding the firearm in the other, thereby compromising the support and stability that is otherwise available in employing a firearm with two hands. One method of reducing some of the loss of support arising when dedicating one hand to employing a flashlight is for an officer to extend the arm with the hand holding the firearm across and on top of the arm with the hand holding the flashlight. This method, however, requires constant readjustment when an officer is in motion or after discharging a firearm and does not direct the beam of light directly along the light of sight of the firearm muzzle. These problems are especially noticeable with the larger flashlights commonly used by law enforcement. Existing flashlights with built-in holders aggravate the problems as the holder design is uncomfortable and difficult to grip when using a firearm. Furthermore, existing flashlights with built-in holders have a design which makes it impractical for an officer to wear such a flashlight around the waist when it is not in use.

Additional solutions to the problems posed in using a firearm and a flashlight involve attaching the flashlight to the firearm itself, which is only suitable for smaller flashlights and impractical when an officer wishes to holster the firearm.

Accordingly, it is an object of the invention to provide alternative and improved means of support for flashlights having no holder. It is a further object of this invention to provide an improved means of attaching and detaching a holder from a flashlight. It is a further object of this invention provide an improved means of holding a flashlight when using a firearm. It is yet a further object of this invention to provide an attachable self-locking flashlight holder which does not impair wearing the flashlight on a utility or holster belt.

SUMMARY OF THE INVENTION

According to the invention there is provided a flashlight holder comprising of a spacer arm extending outwardly from a flashlight housing, means for affixing the spacer arm to the housing, a cantilevered arm connected to the spacer arm at a junction remote from the housing such that a distal end of the cantilevered arm is closer to the housing that its junction with the spacer arm, wherein the distance between the cantilevered arm and the flashlight housing is sufficient to permit the passage of a human hand.

The cantilevered arm may be bowed inwardly towards the flashlight housing.

The means for affixing the spacer may include a split tubular collar dimensioned to removably engage the flashlight housing. The tubular collar may have a cutout which fits around a manual on/off switch to lock the collar to the flashlight housing. The collar may contain a friction enhancing surface on an interior surface of the collar.

The spacer may be detachably affixed to the flashlight housing. The spacer may also be detachably affixed to the collar for greater flexibility of use.

The cantilevered arm may be inclined towards the flashlight housing in the range of 10 to 35 degrees, with a preferred angled of 20 degrees.

In another embodiment, there is a flashlight holder, comprising a spacer arm extending outwardly from a flashlight housing, means for affixing the spacer arm to the housing, including a split tubular collar dimensioned to removably engage the housing, and a cantilevered arm. The cantilevered arm is connected to the spacer arm at a junction remote from the flashlight housing such that a distal end of the cantilevered arm is closer to the housing than its junction with the spacer arm. The cantilevered arm is bowed inwardly towards the housing and includes fingers grips. The distance between the cantilevered arm and the flashlight housing is sufficient to permit the passage of a human hand.

BRIEF DESCRIPTION OF THE DRAWINGS

The novel features believed characteristic of the invention are set forth in the appended claims. The invention itself, however, as well as other features and advantages thereof, will be best understood by reference to the detailed description which follows, read in conjunction with the accompanying drawings, wherein:

FIG. 4 is another side view of the flashlight holder attached to a flashlight and carried in one hand simultaneously while the other hand is holding a gun;

FIG. 5 is a perspective view of the flashlight holder;

FIG. 6 is a side view of an alternative embodiment of the flashlight holder attached to a flashlight;

DETAILED DESCRIPTION WITH REFERENCE TO THE DRAWINGS

Figures 1, 2, 3:
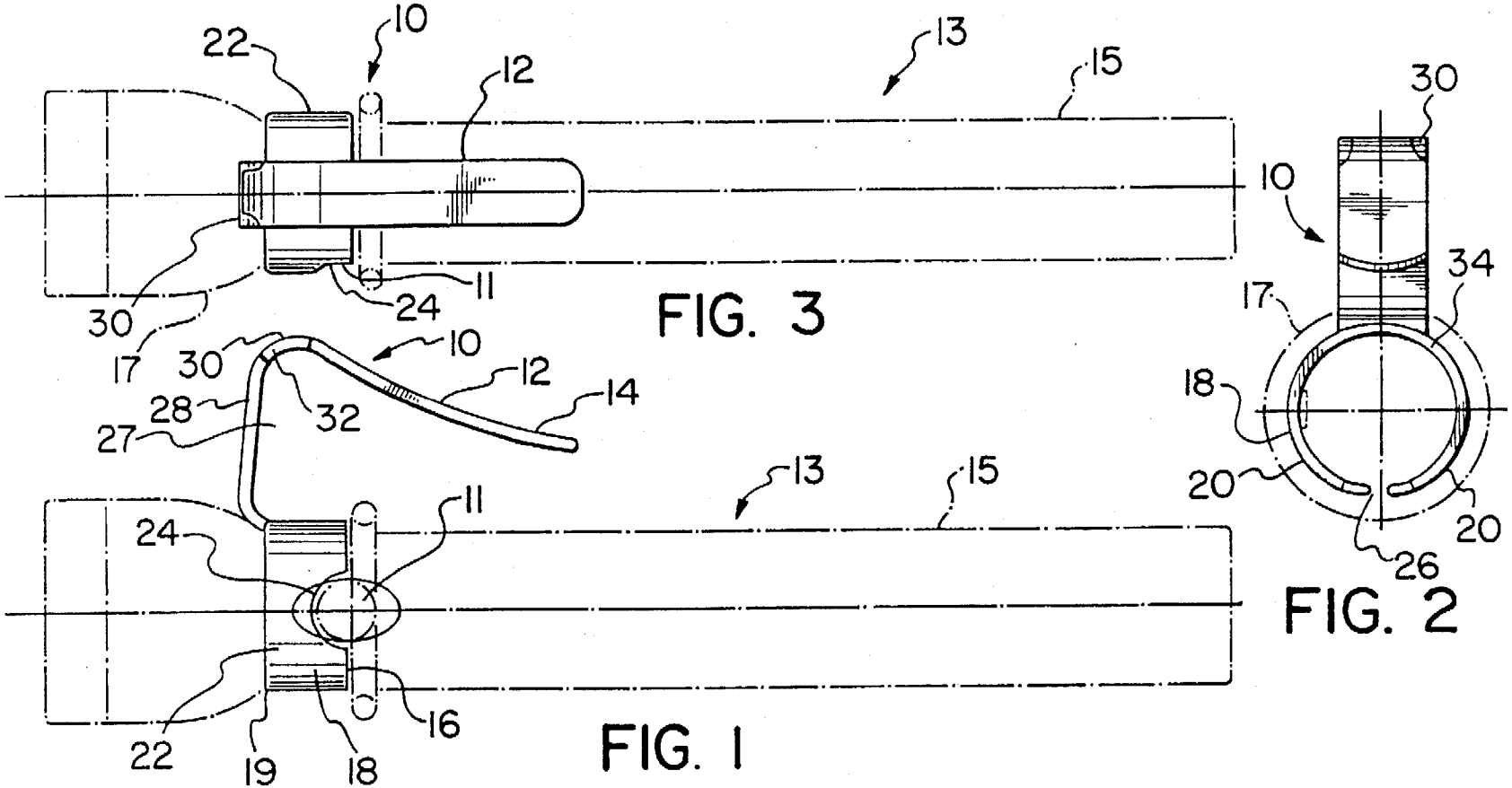
FIG. 1 is a top view of the flashlight holder attached to a flashlight.
FIG. 2 is a side view of the flashlight holder attached to a flashlight.
FIG. 3 is a back view of the flashlight holder attached to a flashlight.

Referring to FIG. 1, a flashlight 13 having exterior tubular housing 15, flashlight head 17 and on-off switch 11 has attached a flashlight holder 10 with cantilevered arm 12 coupled to self-locking tubular collar 22.

Referring to FIGS. 1 and 2, collar 22 consists of tubular sidewall 18, collar arms 20 and opening 26. Collar 22 has a diameter slightly smaller than the diameter of tubular housing 15 and frictionally attaches to housing 15 at region 19 near flashlight head 17. As indicated in FIG. 2 sidewall 18 substantially encircles housing 15 forming collar arms 20 on either side of cantilevered arm 12 which terminate at opening 26. Located on a side 16 of sidewall 18 is cutout 24 which partially encircles switch 11.

Referring to FIGS. 1 and 3, cantilevered arm 12 is bowed inwardly towards housing 15 and is connected at region 32 to spacer arm 28 which extends outwardly from sidewall 18 where sidewall 18 meets with housing 15 and flashlight head 17. Cantilevered arm 12 contains cutouts 30 at region 32 which form finger grip indents 30. When holder 10 is attached to flashlight 13, spacer 28 provides for passageway 27 between cantilevered arm 12 and housing 15.

Cantilevered arm 12 may be inclined towards flashlight housing 15 at an angle in the range of 15 to 25 degrees. The preferred angle at which cantilevered arm 12 is inclined towards flashlight housing 15 is 20 degrees.

Holder 10 is attachable to flashlight 13 by spreading apart collar arms 20 at opening 26 and sliding collar 22 into place along housing 15. Once collar 22 is located substantially close to flashlight head 17, collar arms 20 are released allowing interior sidewall 34 to frictionally attach to housing 15. Holder 10 is detachable from flashlight 13 by again spreading apart collar arms 20 at opening 26 and sliding collar 22 along housing 15.

A illustrated in FIG. 4, holder 10 is employed by mounting cantilevered arm 12 in the palm of a hand and allowing spacer 28 to be placed between any two fingers such that finger grip indents 30 rest comfortably between the fingers. Alternatively, holder 10 may be employed by gripping cantilevered arm 12 longitudinally with a clenched hand.

Referring to FIG. 5, interior sidewall 34 contains grooved serrations 38 which improve frictional engagement. Interior sidewall 34 may also contain frictionally adhesive material.

Referring to FIG. 6, another embodiment of the invention includes modular coupler 40 affixed to collar 22 to which cantilevered arm 12 can attach and detach without the need to decouple the collar 22 from housing 15.

Figure 7:
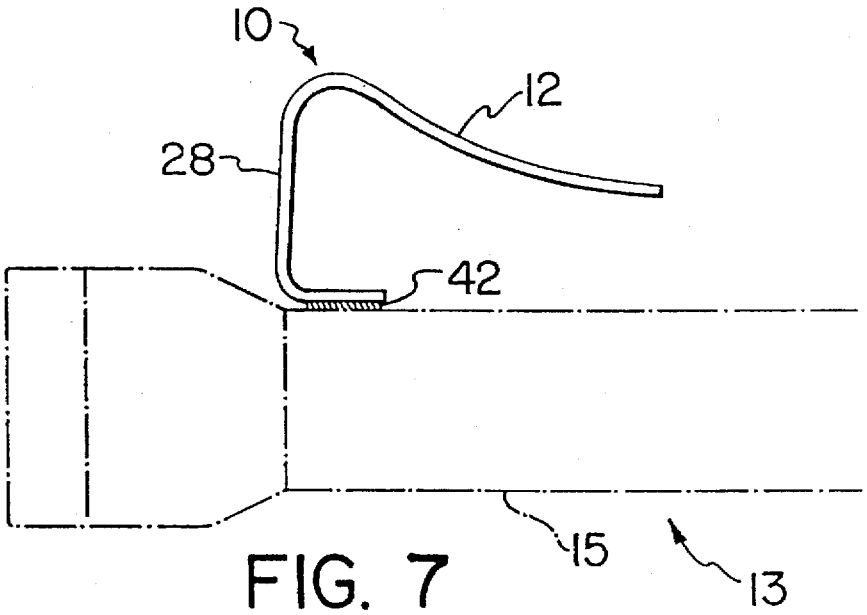
FIG. 7 is a side view of yet another embodiment of the invention.

Referring to FIG. 7, another embodiment of the invention includes detachable spacer 42 affixable to housing 15 without a collar.

It will be obvious to those skilled in the art that no matter what type of spacer is employed, the passageway formed by the spacer must be sufficiently large to permit most hands to fit within passageway 27 when holder 10 is mounted to flashlight 13. It will also be obvious that no matter what type of spacer is employed, the spacer may be oriented to extend outwardly from either end of sidewall 18 or from some exterior surface of sidewall 18. It will also be obvious that no matter what type of hand grip is employed, when holder 10 is mounted to flashlight 13 the spacer arm 28 may be oriented substantially perpendicular to or away from housing 15. It will be further obvious that collar 22 may be mounted to flashlight 13 anywhere along the exterior surface of housing 15. It will also be obvious that spacer 28 may be integral with and part of housing 15. It will be further obvious that a screw clamp or other self-locking means may be used to replace collar 22.

Accordingly, while this invention has been described with reference to illustrative embodiments, this description is not intended to be construed in a limiting sense. Various modifications of the illustrative embodiments, as well as other embodiments of the invention, will be apparent to persons skilled in the art upon reference to this description. It is therefore contemplated that the appended claims will cover any such modifications or embodiments as fall within the true scope of the invention.

I claim:

1. A flashlight holder for use in combination with a flashlight and a firearm, comprising:

(a) a collar operative to slidably attach to a flashlight housing proximate a flashlight head;

(b) a spacer arm dimensioned to fit between a pair of fingers, said spacer arm coupled to said collar and extending outwardly therefrom; and (c) a cantilevered arm having a bowed body with a distal end, said cantilevered arm coupled to said spacer arm at a junction remote from said collar and forming an oblique angle with said spacer arm;

wherein said spacer arm has a length sufficient to permit a user to hold said cantilevered arm in a palm of a hand while said collar is attached to the flashlight housing proximate the flashlight head such that the user can control both the flashlight and the firearm.

2. A holder according to claim 1, wherein said spacer arm has an elongated surface with a pair of finger notches aligned at opposite sides of said elongated surface, said pair of finger notches dimensioned to allow said spacer arm to snugly fit between the pair of fingers when said cantilevered arm is held in the palm of the hand.

3. A holder according to claim 1, wherein said spacer arm is coupled to said collar at an oblique angle such that said spacer arm is inclined towards said collar.

4. A holder according to claim 1, wherein said collar is a split tubular collar dimensioned to removably engage said flashlight housing proximate the flashlight head.

5. A holder according to claim 4, wherein said split tubular collar has a cutout dimensioned to fit around a manual on/off switch so as to lock said split tubular collar to said flashlight housing.

6. A holder according to claim 4, including a friction enhancing surface on an interior surface of said split tubular collar.

7. A holder according to claim 6, wherein said spacer arm has an elongated surface with a pair of finger notches aligned at opposite sides of said elongated surface, said pair of finger notches dimensioned to allow said spacer arm to snugly fit between the pair of fingers when said cantilevered arm is held in the palm of the hand.

8. A holder according to claim 4, wherein said spacer arm is detachably affixed to said collar.

9. A holder according to claim 1, wherein said cantilevered arm is inclined towards said spacer arm at an angle in the range of 2 to 35 degrees.

10. A flashlight holder, for use with a flashlight and a firearm, the flashlight having a flashlight head opposite a rearward end, the flashlight holder comprising:

(a) a spacer arm dimensioned to fit between a pair of fingers, said spacer arm coupled to said flashlight proximate the flashlight head; and (b) a cantilevered arm having a bowed body with a distal end, said cantilevered arm coupled to said spacer arm at a junction remote from said flashlight and forming an oblique angle with said spacer arm such that said cantilevered arm is inclined towards said spacer arm;

wherein said spacer arm has a length sufficient to permit a user to hold said cantilevered arm in a palm of a hand with said spacer arm between the pair of fingers such that the user can control both the flashlight and the firearm.

11. A flashlight holder for use with a flashlight and a firearm, comprising:

(a) a tubular collar operative to removably attach to a flashlight housing proximate a flashlight head, said tubular collar having a friction enhancing interior surface;

(b) a spacer arm dimensioned to fit between a pair of fingers, said spacer arm coupled to said tubular collar and extending outwardly therefrom; and (c) a cantilevered arm having a bowed body with a distal end, said cantilevered arm coupled to said spacer arm at a junction remote from said tubular collar and forming an oblique angle with said spacer arm such that said cantilevered arm is inclined towards said spacer arm;

wherein said spacer arm has a length sufficient to permit a user to hold said cantilevered arm in a palm of a hand with said spacer arm between the pair of fingers while said tubular collar is attached to the flashlight housing proximate the flashlight head so as to permit the user to abut the cantilevered arm with an end of the firearm such that the user can control both the flashlight and the firearm.

12. A holder according to claim 11, wherein said tubular collar has a cutout dimensioned to fit around a manual on/off switch so as to lock said tubular collar to said flashlight housing.

13. A holder according to claim 11, wherein spacer arm has an elongated surface with a pair of finger notches aligned at opposite sides of said elongated surface, said pair of finger notches dimensioned to allow said spacer arm to snugly fit between the pair of fingers when said cantilevered arm is held in the palm of the hand.

14. A holder according to claim 11, wherein said spacer arm is detachably affixed to said collar.

15. A holder according to claim 11, wherein said cantilevered arm is inclined towards said spacer arm at an angle in the range of 2 to 35 degrees.

16. A holder according to claim 11, wherein said cantilevered arm is inclined towards said spacer arm at an angle of about 20 degrees.

* * * * *